United States Patent [19]

Hayatdavoudi

[11] Patent Number: 4,531,592

[45] Date of Patent: Jul. 30, 1985

[54] JET NOZZLE

[76] Inventor: Asadollah Hayatdavoudi, 101 Harwell, Lafayette, La. 70503

[21] Appl. No.: 464,672

[22] Filed: Feb. 7, 1983

[51] Int. Cl.[3] ..... E21B 10/60

[52] U.S. Cl. ..... 175/67; 175/340; 175/420; 239/590

[58] Field of Search ..... 175/420, 393, 339, 340; 239/590, 505, 518, DIG. 7, DIG. 16

[56] References Cited

U.S. PATENT DOCUMENTS

| | | | |
|---|---|---|---|
| 270,488 | 1/1883 | Saunders . | |
| 2,212,491 | 8/1940 | Appleby . | |
| 2,589,942 | 3/1952 | Hruby, Jr. . | |
| 2,699,921 | 1/1955 | Garrison . | |
| 2,885,185 | 5/1959 | Sartor . | |
| 2,963,102 | 12/1960 | Smith . | |
| 2,991,016 | 7/1961 | Allenbaugh, Jr. . | |
| 3,014,544 | 12/1961 | Steen . | |
| 3,019,991 | 2/1962 | Hruby, Jr. . | |
| 3,115,200 | 12/1963 | Mandrell . | |
| 3,213,949 | 10/1965 | Kistler, Jr. . | |
| 3,346,190 | 10/1967 | Shepherd . | |
| 3,509,952 | 5/1970 | Galle | 175/422 |
| 3,528,704 | 9/1970 | Johnson, Jr. . | |
| 3,548,960 | 11/1970 | Hasiba . | |
| 3,744,581 | 7/1973 | Moore | 175/422 |
| 3,747,856 | 7/1973 | Knapp | 239/590 |
| 3,823,789 | 7/1974 | Garner | 175/422 |
| 4,262,757 | 4/1981 | Johnson, Jr. et al. . | |

OTHER PUBLICATIONS

"Increased Penetration Rates Achieved with New Extended Nozzle Bits, Pratt, Journal of Petroleum Technology, Aug. 1978, pp. 1191–1198.

Van Nostrand's Scientific Encyclopedia, Fifth Edition, 1976, pp. 1076–1078.

*Primary Examiner*—William F. Pate, III

*Attorney, Agent, or Firm*—Laney, Dougherty, Hessin, Claro & Beavers

[57] ABSTRACT

Methods and apparatus are provided for extending the effective length of a jet of fluid exiting a nozzle. An elongated jet extension member extends substantially axially outward from a nozzle outlet, and the jet of fluid flowing along and around the extension member tends to cling to the extension member thus decreasing the angle of divergence of the fluid jet.

20 Claims, 15 Drawing Figures

JET NOZZLE

FIELD OF THE INVENTION

The present invention relates to jet nozzles and particularly to an apparatus for extending the effective length of a jet of fluid exiting a jet nozzle.

DESCRIPTION OF THE PRIOR ART

Oil or gas wells are typically drilled with a rotary drilling rig. A long length of drill pipe is suspended from the drilling rig and rotated by a rotary table to turn the drill pipe which has a drill bit attached to the lower end thereof.

The most commonly used drill bit is a tricone rotary bit which has three conical-shaped cutting members rotatably attached to the drill bit body. These conical cutting members have teeth thereon which rotate to grind up the subsurface structure which is being drilled.

Typically, a drilling fluid known as drilling mud is circulated down through the drill pipe and exits jet nozzles disposed in a body of the drill bit. The jets of fluid from the jet nozzle typically are directed between the cones of the drill bit.

These fluid jets perform the function of cleaning material from between the cones of the drill bit, and also of sweeping cuttings and the like off of the bottom of the bore hole so that those cuttings may be entrained in the drilling fluid which then circulates upward through an annulus between the bore hole and the drill pipe.

One problem encountered with such prior art drill bits is that the jet stream of fluid exiting the nozzle does not effectively extend fully downward to the bore hole. This is because the jet action dissipates with distance away from the nozzle. Typically, the nozzles of a tricone rotary drill bit are located three to four inches above the lowermost extremity of the cones so that the nozzle outlet is located three or four inches above the bottom of the bore hole.

Prior art attempts to extend the effective depth of the jet stream exiting the nozzles have generally merely extended an outer cylindrical housing of the nozzle downward towards the bottom of the bore hole. A problem with that solution is that the extended housing very often will be broken off of the drill bit because it encounters very rough handling during the drilling of the well.

SUMMARY OF THE INVENTION

By the present invention, a new means is provided for extending the effective length of the jet of drilling mud exiting the nozzle of the drill bit. In its broader aspects, this invention is applicable to extend the effective length of most any fluid jet exiting most any type of nozzle.

A rotary drill bit constructed in accordance with the present invention includes a drill bit body having a cutting means extending downward from the drill bit body. A nozzle passage means is disposed in the drill bit body, preferably by disposing the nozzle passage means in a nozzle insert which itself is received in and detachably connected to the drill bit body. The nozzle passage means has a downwardly open nozzle outlet located above a lower end of the cutting means. The nozzle passage means provides a means for directing a jet of drilling fluid downward toward a bottom of a hole being drilled by the cutting means. An elongated jet extension member extends substantially axially downward from the nozzle outlet.

The elongated jet extension member provides a means for extending an effective length of a jet of fluid exiting the nozzle outlet by causing the jet of fluid to follow the extension member and diverge less than the jet of fluid would diverge in the absence of the extension member.

It is an object of the present invention to provide an improved jet nozzle.

Another object of the present invention is the provision of an improved drilling apparatus wherein the effective length of jets of drilling fluid exiting the drilling apparatus is extended.

Yet another object of the present invention is the provision of an extension member for a nozzle, which extension member is constructed so that a distance which the extension member extends from the nozzle outlet may be varied in response to axial forces exerted upon the extension member.

And another object of the present invention is the provision of an extension member for a jet nozzle which extension member is pivotally connected to the jet nozzle so that an extremity of the extension member can move laterally relative to the jet nozzle when lateral forces are exerted upon the extension member.

Yet another object of the present invention is the provision of an improved nozzle insert for an earth drill bit.

Other and further objects, features and advantages of the present invention will be readily apparent to those skilled in the art in view of the following disclosure when taken in conjunction with the accompanying drawings.

DETAILED DESCRIPTION OF THE PREFERRED EMBODIMENTS

Figure 1:
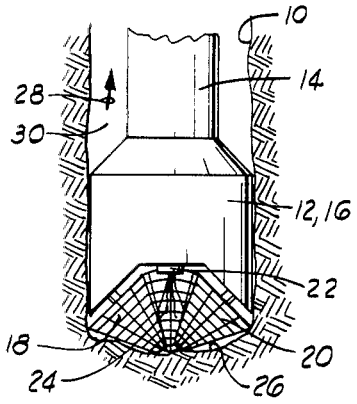
FIG. 1 PRIOR ART
FIG. 1 is a schematic elevation view of a typical prior art rotary drill bit drilling a bore hole in the earth.

Referring now to the drawings, and particularly to FIG. 1, a bore hole 10 of an oil or gas well is typically drilled by a tricone rotary bit 12 attached to the lower end of a drill string 14 which is rotated by a rotary drilling rig (not shown) at the earth's surface.

The rotary drill bit 12 typically includes three cone-shaped cutting members rotatably attached to a drill bit body 16. Two of the cone-shaped cutting members are shown in FIG. 1 and are designated by the numerals 18 and 20.

Typically, there are three jet nozzles disposed in the drill bit body 16, and those jet nozzles are located one between each pair of adjacent cutting members, such as 18 and 20. In FIG. 1, one of the jet nozzles is shown schematically and designated by the numeral 22. A jet stream of drilling mud exiting the nozzle 22 is illustrated schematically and designated by the numeral 24.

As the drill string 14 and drill bit 12 are rotated, the cutting members 18, 20 cut into the earth at the bottom 26 of the bore hole 10.

The drilling mud exiting the nozzles such as 22 cleans material from between the cutting members 18, 20 and sweeps cuttings off of the bottom 26 of the bore hole so that they may be carried upward as indicated by arrow 28 through an annulus 30 between the bore hole 10 and the drill string 14.

The apparatus just described and illustrated in FIG. 1 is a part of the prior art.

Figure 2:
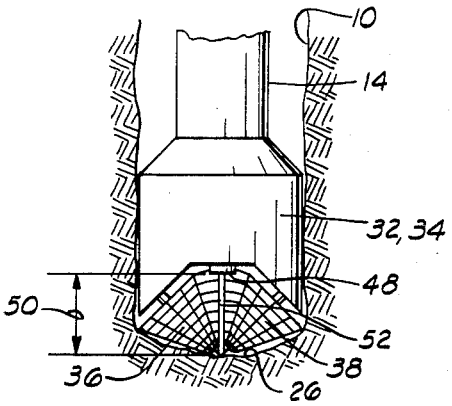
FIG. 2 is a schematic elevation view of an earth drilling apparatus of the present invention which includes an elongated jet extension member extending downwardly from a nozzle.

FIG. 2 is a schematic illustration of the present invention and shows a modified drill bit 32.

The drill bit 32 includes a drill bit body 34 having cutting means such as rotatable cones 36 and 38 extending downward from the drill bit body 34. The drill bit body 34 and the cutting members 36 and 38 may be constructed identically to the drill bit body 16 and the cutting means 18 and 20 of the prior art apparatus shown in FIG. 1.

The drill bit body 32 has a drilling fluid passageway 40 (see FIG. 3) disposed therethrough for communicating drilling fluid from the interior of the drill string 14 with the nozzles.

A portion of the drilling fluid passageway 40 is coincident with a nozzle passage means 42. The nozzle passage means 42 is preferably disposed through a nozzle insert 44.

Nozzle passage means 42 extends from a nozzle inlet 46 to a nozzle outlet 48.

Nozzle outlet 48 is downwardly open and is located above a lower end or lowermost extremity of the cutting members 36 and 38.

In FIG. 2, the nozzle outlet 48 is indicated schematically and is shown to be located a distance 50 above the lowermost extremity of the cutting members 36 and 38.

A jet of drilling fluid exits the nozzle outlet 48 and is directed downwardly toward the bottom 26 of the bore hole 10 being drilled by the cutting members 36 and 38.

An elongated jet extension member 52 is shown in FIG. 2 extending downward from the nozzle outlet 52.

Figure 3:
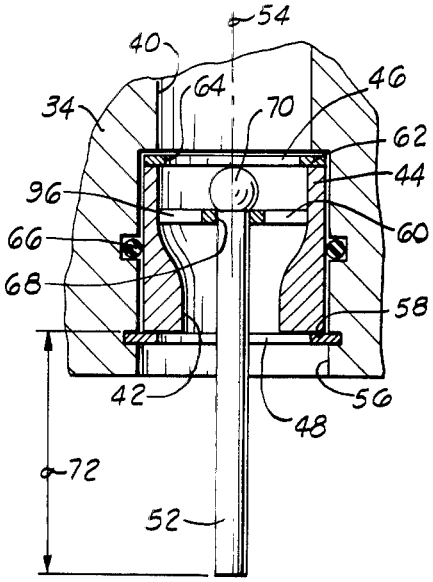
FIG. 3 is a partial enlarged sectioned schematic illustration of the nozzle portion of the earth drilling apparatus of FIG. 2 showing a nozzle insert in place within the drill bit body, and showing an elongated jet extension member in place within the nozzle insert.

As seen in FIG. 3, the extension member 52 is located coincident with a central longitudinal axis 54 of nozzle insert 44 and extends substantially axially downward from nozzle outlet 52.

The elongated jet extension member 52 provides a means for extending an effective length of the jet of fluid exiting the nozzle outlet 48 by causing that jet of fluid to follow the extension member 52 and to diverge less than a jet of fluid would diverge in the absence of the extension member 52.

It will be understood that the term "downward" when used in the context of describing the direction in which the extension member 52 extends relative to the drill bit 32 is used in a relative sense using conventional language of the drilling industry which generally refers to the orientation of such parts as they would have relative to each other when drilling vertically straight downward. It is, of course, understood that oil or gas wells may be drilled at an angle to the vertical, and it is even possible to drill portions of the well substantially horizontally, but still the face 26 of the bore hole 10 being drilled is referred to as the bottom of the bore hole and distances from that drilling face traversing back toward the previously drilled portions of the bore hole are referred to as up. Similarly, when the nozzle outlet 48 is defined as being "above" a lowermost extremity of the cutting members 36 and 38, it is understood that this terminology still applies in the relative sense even if the bore hole is being drilled at an angle to the vertical or even if it is being drilled horizontally.

With prior art drill bits having conventional nozzle inserts disposed therein, the nozzle insert is typically disposed in a slightly enlarged diameter counterbore of the drilling fluid passageway and is held in place therein by a lock ring. The construction shown in FIG. 3 for the present invention is similar to the prior art with regard to the manner in which the nozzle insert 44 is held in place. The drilling fluid passageway 40 includes a counterbore 56 within which the nozzle insert 44 is held by a lock ring 58.

A spider framework 60 has been disposed in the nozzle insert 44 for holding the extension member 52 in place relative to the nozzle insert 44.

A washer 62 has been disposed within the counterbore 56 above the nozzle insert 44 and has an internal diameter 64 sufficiently small to prevent the spider frame 60 from moving upward out of the nozzle insert 44.

An O-ring seal 66 is disposed in the counterbore 56 for sealing between the nozzle insert 44 and the drill bit body 34. Typical prior art drill bits having conventional nozzle inserts also have an O-ring seal similar to the O-ring seal 66.

The extension member 52 is loosely slidingly received within a central opening 68 of spider frame 60. Extension member 52 has an enlarged upper end 70 which is sufficiently large that the upper end 70 cannot pass downward through the central opening 68. Thus the extension member 52 is prevented from falling downward through the nozzle outlet 48.

The extension member 52 is constructed so that when it is fully extended downward from the nozzle outlet 48 with the enlarged upper end 70 engaging the spider frame 60, the extension member 52 extends downward a distance 72 (see FIG. 3) greater than the distance 50 (see FIG. 2) at which the lowermost extremity of cutting means 36 and 38 is located below the nozzle outlet 48, so that when the extension member 52 is fully extended downward from the nozzle outlet 48 it extends below a lowermost portion of the cutting members 36 and 38.

The sliding connection between extension member 52 and the spider frame 60 provides an extension adjustment means, operably associated with the extension member 52, for varying a distance which the extension member 52 extends downward from the nozzle outlet 48 in response to an upward force exerted upon a lower end 74 of the extension member 52.

Thus, when the drill bit 32 is lowered into the bore hole 10 with the cutting members 36 and 38 engaging the bottom 26 of the bore hole 10, the lower end 74 of extension member 52 engages the bottom 26 of the bore hole 10 and pushes the extension member 52 upward relative to the nozzle insert 44.

Also, since the extension member 52 is loosely received within the central opening 68 of spider framework 60, the extension member 52 may be said to be pivotally connected to the spider framework 60 and thus to the drill bit body 34 so that the lower end 74 of the extension member 52 can move laterally relative to the drill bit body 34 when lateral forces are exerted upon the extension member 52.

Thus, this loose sliding connection between the extension member 52 and the spider framework 60, and accordingly between the extension member 52 and the drill bit body 34, allows the extension member 52 to move axially or laterally in response to the somewhat turbulent and random forces which will be exerted thereon by the action of the drill bit 32 rotating within the bore hole 10 and cutting against the bottom 26 of the bore hole 10. This prevents the extension member 52 from being broken off by the extreme forces which will be encountered during the relatively rough handling encountered by the drill bit 32.

Figure 4:
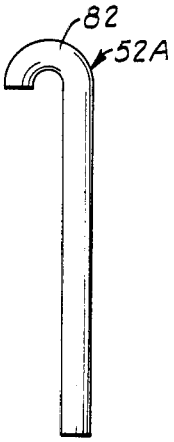
FIG. 4 is an elevation view of an alternative embodiment of the elongated jet extension member having a modified enlarged upper end.
Figure 5:
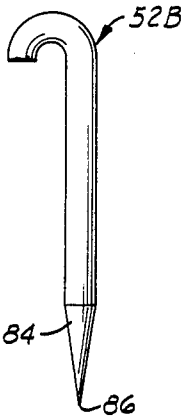
FIG. 5 is an elevation view of another alternative embodiment of the elongated jet extension member having a tapered conical lower end.
Figure 6:
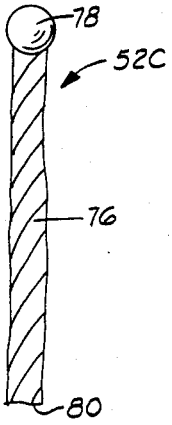
FIG. 6 is an elevation view of yet another alternative embodiment of the elongated jet extension member, which is constructed from a length of flexible material such as rope or the like, and which has a ball-shaped enlarged upper end.

Alternative embodiments of the extension member 52 are illustrated in FIGS. 4, 5 and 6 and are designated by the numerals 52A, 52B and 52C, respectively.

Referring to the embodiment of FIG. 6, the extension member 52 may be constructed with an elongated portion 76 constructed from a flexible material such as rope or the like. Preferably, the flexible portion 76 of the extension member 52C is constructed from a material which is erosion resistant such as teflon, nylon or polyurethane rope or cord. A hard enlarged upper end 78 is attached to the flexible portion 76 to hold it in place within spider framework 60. Thus, for the embodiment of FIG. 6, the extension adjustment means allowing the lower end 80 of the flexible member 76 to move upward to vary the distance between that lower end 80 of extension member 52C and the nozzle outlet 48 is provided by the flexible construction of the extension member 52C.

Similarly, the flexible construction of the extension member 52C also provides a pivotal connection between the extension member 52C and the drill bit body 34 so that the lower end 80 of the extension member 52C can move laterally relative to the drill bit body 34 when lateral forces are exerted upon the flexible portion 76 of extension member 52C.

The extension members 52, 52A, 52B and 52C shown in FIGS. 3, 4, 5 and 6, respectively, are all circular in cross-section throughout most of their length.

The extension member 52A shown in FIG. 4 differs from the extension member 52 of FIG. 3 only in the construction of the upper end 82 thereof. The upper end 82 is constructed in a hook shape rather in a ball shape.

The extension member 52B shown in FIG. 5 has an upper end similar to the one shown in FIG. 4, but has a lower end portion 84 thereof shaped so as to be conically tapered to a lower tip 86.

Figure 7:
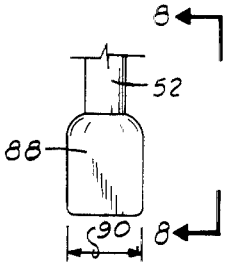
FIG. 7 is a partial lower end view of yet another alternative embodiment of the elongated jet extension member, showing a flattened lower end portion.
Figure 8:
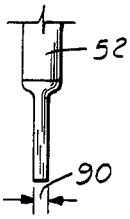
FIG. 8 is a side view of the embodiment of FIG. 7 taken along lines 8—8 of-FIG. 7.
Figure 9:
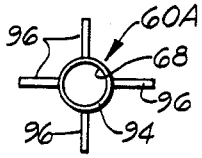
FIG. 9 is a plan schematic view of one embodiment of a spider frame shown in FIG. 3 for supporting the elongated jet extension member within the nozzle insert.

FIGS. 7 and 8 show side elevation views, taken 90° apart, of an alternative shape for the lower end portion of any of the extension members 52, 52A, 52B or 52C.

In the embodiment shown in FIGS. 7 and 8, there is a flattened lower end portion 88 on the extension member 52 which has a width 90 greater than a diameter of the circular cross-sectional portion of extension member 52, and which has a thickness 92 less than a diameter of the circular cross-sectional portion of the extension member 52.

The modified lower ends such as those shown in FIG. 5 or FIGS. 7 and 8 are used to modify the shape of the fluid jet so as to modify its effect in cleaning the bottom 26 of the bore hole 10.

With the conically shaped lower end 84 tapering to a tip 86 as shown in FIG. 5, the fluid jet clinging to the outer walls of the extension member 52B tends to be drawn in towards its axis so that the jet has a circular-shaped impact area on the bottom 26 of the bore hole 10.

With the flattened lower end 88 shown in FIGS. 7 and 8, the jet stream tends to spread across the width 90 of the extension member 52 so that a substantially rectangular-shaped impact area is created on the bottom 26 of the bore hole 10.

With the embodiment shown in FIGS. 7 and 8, it is apparent that it would be necessary to construct the intermediate portion of extension member 52, which has the circular cross-section, in two parts which are threaded together, or to have either the upper end 70 or the lower end 88 detachably connected to the intermediate portion so that the intermediate circular cross-sectional portion of the extension member 52 could be placed through the central opening 68 of the spider frame 60.

FIGS. 9–12 show several alternative embodiments of the spider frame 60 which are designated by the numerals 60A, 60B, 60C and 60D, respectively.

In the embodiment shown in 60A, the central opening 68 is defined by the inner diameter of a circular ring 94.

Extending radially outward from the ring 94 are four spider legs 96, the radially outer ends of which engage the nozzle passage 42 of nozzle insert 44 as shown in FIG. 3.

Figure 10:
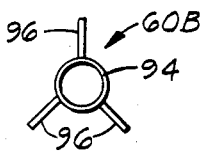
FIGS. 10, 11 and 12 show various alternative embodiments of the spider frame of FIG. 9.
Figure 11:
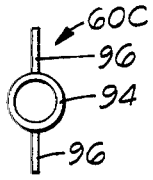

FIGS. 10 and 11 show similar embodiments 60B and 60C which have three and two radially extending legs, respectively.

Figure 12:
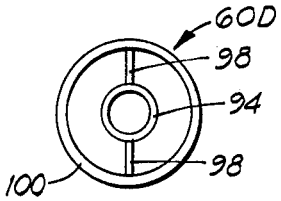

The spider frame 60D of FIG. 12 has the inner ring 94 with two legs 98 extending to an outer ring 100 which is constructed to be received within the nozzle passage 42.

Figure 13:
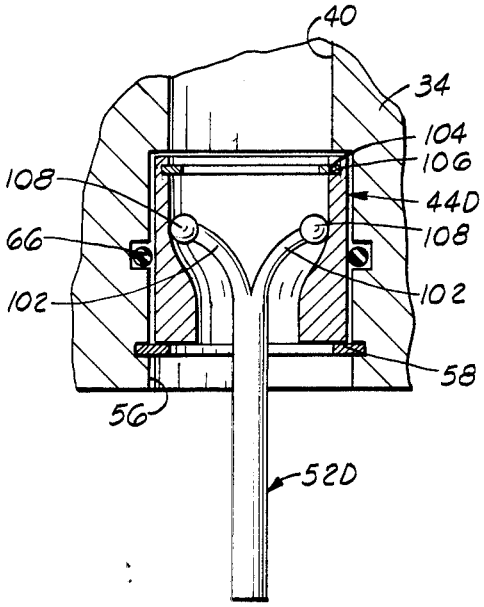
FIG. 13 is a partial schematic elevation sectioned view similar to FIG. 3 showing an alternative embodiment of both the elongated jet extension member and the nozzle insert. The elongated jet extension member has a plurality of laterally extending arms on its upper end.
Figure 14:
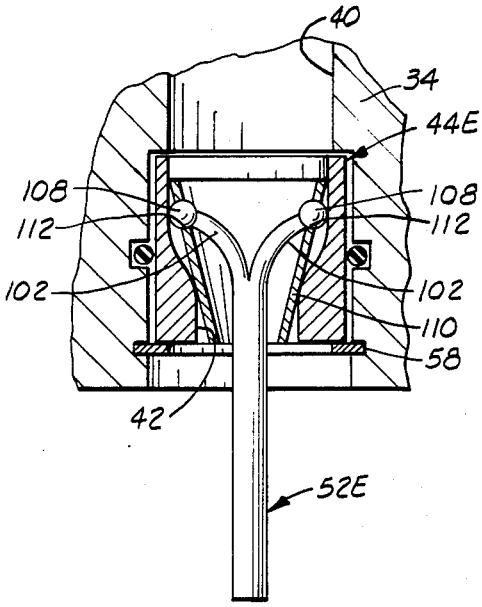
FIG. 14 is a partial schematic elevation sectioned view of yet another alternative embodiment of the elongated jet extension member and nozzle, insert.
Figure 15:
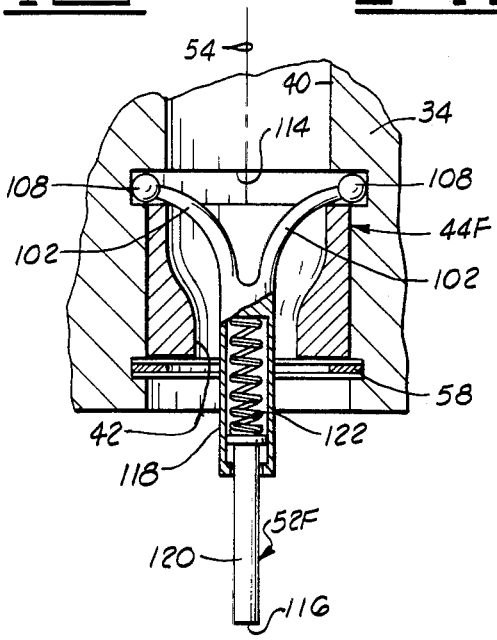
FIG. 15 is a partial schematic elevation sectioned view of another alternative embodiment of the elongated jet extension member and nozzle insert.

Referring now to FIGS. 13–15, several additional alternative embodiments for the extension member are illustrated and the extension member is designated by the numerals 52D, 52E and 52F in FIGS. 13–15, respectively. Each of the embodiments 52D, 52E and 52F include a plurality of laterally extending arms 102 at the upper end of the extension member. The arms 102 each have a ball-shaped upper end 108. The arms 102 engage the nozzle insert to hold the extension member within the nozzle insert.

Referring to FIG. 13, a modified nozzle insert 44D includes a lock ring 104 disposed in a groove 106 for limiting upward movement of extension member 52D relative to the nozzle insert 44D. It can be seen from viewing FIG. 13, that the extension member 52D can slide axially upward relative to the nozzle insert 44 through a limited distance, and also that the lower end of extension member 52D can move laterally with one of the ball-shaped ends 108 of one arm 102 moving relatively upward and the ball-shaped end 108 of the other arm 102 moving relatively downward thus providing a pivotal motion of extension member 52D relative to drill bit body 34.

FIG. 14 shows another embodiment of the present invention utilizing an extension member 52E having a wishbone-shaped upper end like that just described for FIG. 13.

In the embodiment of FIG. 14, the nozzle insert 44E includes a hollow truncated inverted conical liner 110 having openings or recesses 112 within which the ball-shaped ends 108 of the arms 102 of extension member 52E are received.

The liner 110 is concentrically and loosely received within nozzle passageway 42 so that the liner 110 and extension member 52 may move axially relative to nozzle insert 44E and so that they can also pivot relative to nozzle insert 44E to allow the lower end of extension member 52E to move laterally relative to the drill bit body 34.

Referring now to FIG. 15, yet another embodiment of the present invention is illustrated utilizing an extension member 52F having a wishbone-shaped upper end. In this embodiment, the ball-shaped upper ends 108 of the arms 102 are received within an inner annular groove 114 disposed in drilling fluid passageway 40.

The extension member 52F can pivot relative to drill bit body 34 about an axis drawn through the two ball-shaped ends 108. The ball-shaped ends 108 are free to move within the groove 114 thus allowing the extension member 52F to rotate about the central axis 54 of nozzle passage 42.

In order to provide an extension adjustment means in the embodiment of FIG. 15, for allowing the lower end 116 of the extension member 52F to move upward relative to the drill bit body 34, the extension member 52F is constructed to have an upper cylindrical portion 118 having a lower cylindrical portion 120 slidably received therein, with a compression spring member 122 disposed therebetween to urge the lower portion 120 downward relative to the upper portion 118.

Theory of Operation

A jet of fluid exiting a nozzle generally includes a central core of the jet which comprises fluid flowing in a substantially linear fashion, with the turbulence of the fluid increasing with radial distance away from the central axis of the jet.

The jet of fluid diverges with axial distance away from the nozzle outlet so that the cross-sectional area of ambient fluid effected by the jet increases in proportion to the square of the distance away from the nozzle outlet. As the cross-sectional area of the jet increases, the impacting force of the jet per unit of area necessarily decreases since the energy is distributed across the entire area being effected.

In an environment such as an oil well, where the jet is flowing through a very dense environment of drilling mud, this dissipating effect occurs very rapidly so that the force from the jet impacting on the bottom of the bore hole is greatly decreased with distance away from the nozzle outlet.

By means of the present invention, the angle of divergence of the jet is decreased.

This is because the core flow of the jet tends to cling to the cylindrical outer surface of the elongated extension member thus reducing the divergence effect. This cylindrical outer surface may generally be referred to as a peripherally encompassing external surface extending generally parallel to a longitudinal axis of the elongated extension member, it being understood that such a peripherally encompassing external surface need not always be perfectly circular in cross section although that is the preferred construction. Thus, more highly concentrated impacting forces are provided by the jet on the bottom 26 of the bore hole 10 than would be provided in the absence of extension member 52.

This tendency of the jet to cling to the cylindrical outer surface of the elongated extension member is due to the fact that if the jet did diverge, a region of lower pressure would be created in the annular space between the cylindrical outer surface of the extension member and radially innermost region of the jet. Thus, there would be a radially inward directed pressure differential causing the jet to cling to the extension member. This is true so long as the jet provides a substantially solid wall of water around the extension member. At some distance from the nozzle the jet will break up due to turbulence and loss of velocity, however, and at that point this clinging tendency would be lost and that portion of the jet which is not already dissipated would diverge. This phenomenon is similar to the principle of fluidics known as the Coanda effect which recognizes that a jet bounded above and below by two plates, with one side of the jet spaced from a closed wall and the other side of the jet open to atmosphere, will tend to cling to the closed wall.

Also, it is believed that by directing the energy from the nozzles more directly downward, erosion of the side walls of the bore hole 10 will be reduced.

The flexible sliding connection of the extension member 52 to the drill bit body 34 prevents the extension member 52 from being broken off by the impacting of the extension member 52 against rock cuttings and the like within the bore hole 10. In the absence of a lateral force on the extension member 52, however, the extension member 52 will align itself coincident with the axis 54 of nozzle passageway 42 when the jet of fluid is flowing along the extension member 52.

Although the preferred embodiment of the invention described in detail above has been illustrated with reference to a jet nozzle of a drilling bit, it will be appreciated that the present invention may be utilized with any fluid jet wherein advantages would be obtained by extending the effective length of the jet of fluid exiting the nozzle. The term effective length is utilized to refer to the distance the jet can traverse without dissipating to the extent that it can no longer perform the necessary function.

Thus, in its broader forms, the present invention is believed to be applicable to any number of tools utilizing fluid jets, such as other types of drill bits, torch cutters, propulsion rockets and jet engines, pneumatic hole punchers, and the like.

Since the dissipation of the fluid jet begins immediately when the fluid jet exits the outlet such as the nozzle outlet 48 of the particular nozzle involved, it is believed that it is only that portion of the extension member which extends beyond the nozzle outlet which is of particular significance. The extension member should be sufficiently long to achieve the particular purpose involved, and it is generally believed that the extension member should extend beyond the nozzle outlet a distance greater than the diameter of the nozzle outlet and preferably several times the diameter of the nozzle outlet.

Thus, it is seen that the apparatus and methods of the present invention readily achieve the ends and advantages mentioned as well as those inherent therein. While certain preferred embodiments of the present invention have been illustrated for the purposes of this disclosure, numerous changes in the arrangement and construction of parts and steps may be made by those skilled in the art, which changes are embodied within the scope and spirit of the present invention as defined by the appended claims.

What is claimed is:

1. An earth drill bit apparatus comprising:

a drill bit body;

a cutting means extending downward from said drill bit body;

a nozzle passage means, disposed in said drill bit body and having a downwardly open nozzle outlet located above a lowermost portion of said cutting means, for directing a jet of drilling fluid downward toward a bottom of a hole being drilled by said cutting means; and an elongated jet extension member extending substantially axially downward from said nozzle outlet, said jet extension member having a peripherally encompassing external surface extending generally parallel to a longitudinal axis of said jet extension member, said extension member being so arranged and constructed that said jet of drilling fluid flows downward about and completely surrounds said peripherally encompassing external surface of said extension member.

2. The apparatus of claim 1, wherein:

said elongated jet extension member is further characterized as a means for extending a length of a jet of fluid exiting said nozzle outlet by causing said jet to follow said external surface of said extension member and diverge less than said jet would divere in the absence of said extension member.

3. The apparatus of claim 1, wherein:

said elongated jet extension member is circular in cross-section along a majority of its length.

4. The apparatus of claim 3, wherein:

said extension member has a lower end portion thereof conically downwardly convergingly tapered to a lower tip.

5. The apparatus of claim 1, wherein:

said nozzle passage means is disposed through a nozzle insert, said nozzle insert being received in and detachably connected to said drill bit body.

6. The apparatus of claim 5, further comprising:

a spider frame disposed in said nozzle passage means of said nozzle insert and having said extension member suspended therefrom.

7. A nozzle assembly comprising:

a nozzle body having a nozzle passage disposed therethrough, said nozzle passage extending from a nozzle inlet to a nozzle outlet; and an elongated jet extension means, extending substantially axially outward from said nozzle outlet a distance greater than a diameter of said nozzle outlet, for extending a length of a jet of fluid exiting said nozzle outlet by causing said jet to follow a peripherally encompassing external surface of said extension means and diverge less than said jet would diverge in the absence of said extension means.

8. A method of extending a length of a jet of fluid exiting a nozzle outlet, comprising:

(a) providing an elongated jet extension member extending outward from said nozzle outlet a distance greater than a diameter of said nozzle outlet;

(b) flowing said jet of fluid about a peripherally encompassing external surface of said extension member along a length of said extension member and thereby causing said jet to follow said extension member;

(c) thereby decreasing a lateral divergence of said jet of fluid as compared to the divergence which would occur in the absence of said extension member; and (d) thereby extending said length of said jet of fluid

9. An earth drill bit apparatus comprising:

a drill bit body;

a cutting means extending downward from said drill bit body;

a nozzle passage means, disposed in said drill bit body and having a downwardly open nozzle outlet located above a lowermost portion of said cutting means, for directing a jet of drilling fluid downward toward a bottom of a hole being drilled by said cutting means;

an elongated jet extension member extending substantially axially downward from said nozzle outlet; and extension adjustment means, operably associated with said elongated jet extension member, for varying a distance which said extension member extends downward from said nozzle outlet in response to an upward force exerted upon a lower end of said extension member.

10. The apparatus of claim 9, wherein:

said extension member is constructed so that when it is fully extended downward from said nozzle outlet, it extends below said lowermost portion of said cutting means.

11. The apparatus of claim 9, wherein:

said extension adjustment means is provided by a flexible construction of said extension member.

12. The apparatus of claim 9, wherein:

said extension adjustment means is provided by a sliding connection between said drill bit body and said extension member.

13. The apparatus of claim 12, wherein:

said extension member is slidingly received in a central opening of a spider frame disposed in said nozzle passage means, and said extension member includes an enlarged upper end which is too large to pass through said central opening.

14. The apparatus of claim 9, wherein:

said extension member is pivotally connected to said drill bit body so that said lower end of said extension member can move laterally relative to said drill bit body when lateral forces are exerted upon said extension member.

15. The apparatus of claim 14, wherein:

said extension adjustment means and said pivotal connection of said extension member to said drill bit body are both provided by a loose sliding connection between said drill bit body and said extension member.

16. The apparatus of claim 14, wherein:

said extension adjustment means and said pivotal connection of said extension member to said drill bit body are both provided by constructing said extension member from a flexible material.

17. An earth drill bit apparatus comprising:

a drill bit body;

a cutting means extending downward from said drill bit body;

a nozzle passage means, disposed in said drill bit body and having a downwardly open nozzle outlet located above a lowermost portion of said cutting means, for directing a jet of drilling fluid downward toward a bottom of a hole being drilled by said cutting means;

an elongated jet extension member extending substantially axially downward from said nozzle outlet; and wherein said elongated jet extension member is circular in cross section along a majority of its length, and has a flat lower end portion having a thickness less than a diameter of said circular cross section.

18. An earth drill bit apparatus comprising:

a drill bit body;

a cutting means extending downward from said drill bit body;

a nozzle passage means, disposed in said drill bit body and having a downwardly open nozzle outlet located above a lowermost most portion of said cutting means, for directing a jet of drilling fluid downward toward a bottom of a hole being drilled by said cutting means;

an elongated jet extension member extending substantially axially downward from said nozzle outlet;

wherein said nozzle passage means is disposed through a nozzle insert, said nozzle insert being received in and detachably connected to said drill bit body; and wherein said extension merber has a plurality of laterally extending arms at its upper end, said arms engaging said nozzle insert to hold said extension member in said nozzle insert.

19. The apparatus of claim 18, wherein:

said nozzle insert includes a hollow truncated inverted conical liner concentrically received in said nozzle passage means; and said arms of said extension member engage recesses of said conical liner.

20. A method of extending a length of a jet of fluid exiting a nozzle outlet, comprising:

(a) providing an elongated jet extension member extending along a central axis of said nozzle outlet outward from said nozzle outlet a distance greater than a diameter of said nozzle outlet;

(b) flowing said jet of fluid substantially concentrically about said extension member along a length of said extension member and thereby causing said jet to follow said jet extension member;

(c) thereby decreasing a lateral divergence of said jet of fluid as compared to the divergence which would occur in the absence of said extension member; and (d) thereby extending said length of said jet of fluid.

* * * * *

UNITED STATES PATENT AND TRADEMARK OFFICE

CERTIFICATE OF CORRECTION

PATENT NO. : 4,531,592

DATED : July 30, 1985

INVENTOR(S) : Asadollah Hayatdavoudi

It is certified that error appears in the above-identified patent and that said Letters Patent is hereby corrected as shown below:

Column 3, line 9, delete ",".

Column 9, Claim 2, line 51, delete "divere" and insert --diverge--.

Column 12, Claim 18, line 11, delete "merber" and insert --member--.

Signed and Sealed this

*Fifth* Day of *November 1985*

[SEAL]

*Attest:*

*Attesting Officer*

DONALD J. QUIGG

*Commissioner of Patents and Trademarks*